United States Patent [19]

Mariotto née Amiel

[11] Patent Number: 4,925,418

[45] Date of Patent: May 15, 1990

[54] INDIVIDUAL RESCUE APPARATUS

[75] Inventor: Monique Mariotto née Amiel, Toulouse, France

[73] Assignee: Claude Mariotto, Toulouse, France

[21] Appl. No.: 275,132

[22] PCT Filed: Mar. 9, 1987

[86] PCT No.: PCT/FR87/00059

§ 371 Date: Sep. 13, 1988

§ 102(e) Date: Sep. 13, 1988

[87] PCT Pub. No.: WO87/05578

PCT Pub. Date: Sep. 24, 1987

[30] Foreign Application Priority Data

Mar. 13, 1986 [FR] France ..... 86 03954

[51] Int. Cl.[5] ..... B63C 9/16

[52] U.S. Cl. ..... 441/92; 441/108; 441/113; 441/115

[58] Field of Search ..... 441/92–94, 441/106, 108, 111–120

[56] References Cited

U.S. PATENT DOCUMENTS

| | | | |
|---|---|---|---|
| Re. 31,305 | 7/1983 | Moran | 441/123 |
| 1,759,336 | 5/1930 | Wollk | 222/5 |
| 2,145,289 | 1/1939 | Boudreaux | 441/108 |
| 2,784,426 | 3/1957 | Boyle et al. | 441/111 |
| 3,119,132 | 1/1964 | Nayar | 441/96 |
| 4,360,351 | 11/1982 | Travinski | 441/94 |
| 4,626,221 | 12/1986 | Rocco | 441/108 |

FOREIGN PATENT DOCUMENTS

| | | |
|---|---|---|
| 2224343 | 10/1974 | France . |
| 2244666 | 4/1975 | France . |
| 2466391 | 4/1981 | France . |

*Primary Examiner*—Sherman D. Basinger

*Attorney, Agent, or Firm*—Harold H. Dutton, Jr.

[57] ABSTRACT

An individual rescue apparatus for use around the waist of a person comprising a waist encircling support belt (1) with a Fastener (**2*a*,2*b*) at its extremities, an inflation system (9–14) adapted to be secured to the support belt, a pressurized gas reservoir adapted to be able to be placed in communication with the inflation system, and a release device adapted to assure the inflation of the system from the gas reservoir, the inflation system comprising a atubular portion (9) extending along the support belt and connected to the gas reservoir, and cells (11–14) distributed along the tubular portion and communicating therewith for inflating the cells by the action of the release device, the support belt (1) comprising an upward extension (3) of a height adapted to extend approximately above the center of gravity of the person when the belt is worn around the waist, the extension (3) being provided with an attaching zone (3*a*) in its upper portion, the inflation system (9–14) being maintained, in the passive position, along the support belt (1) by a releasable securing device (18, 19) capable upon inflation of releasing the cells (11–14) of the system, a connection (15–17) between the support belt and the inflation system, comprising at least one connection (15) for connecting the attaching zone (3*a***) of the extension and the inflation system.

12 Claims, 5 Drawing Sheets

INDIVIDUAL RESCUE APPARATUS

The invention relates to an individual rescue apparatus intended to be arranged around the waist of a person. The invention also relates to an apparatus comprising an inflatable system capable of being inflated in case of need, either by a manual operation of the user or by an automatic process upon contact with the water.

Apparatus of the type described above seek to provide, upon inflation, a flotation volume capable of maintaining the wearer on the surface of the water. In practice, only the devices arranged around the waist combine, first, in the passive state a discrete and comfortable wearing, in order to avoid being a burden for the wearer, and in the active state, a flotation capability sufficient to offer complete safety.

The apparatus of this type are particularly described in French patents Nos. 74.10858, 74.32195, 79.24854. However, these apparatuses have a serious drawback: the flotation volume develops at the level of the waist of the wearer, i.e. below the center of gravity of the wearer. Such apparatus is incapable of keeping the person stable on the surface of the water while assuring that the person's head remains above the surface. In particular, at the time of inflation, these devices develop a force tending to up-end the user, thus immersing the top of the body of the wearer.

The present invention proposes to overcome the deficiencies of known devices discussed above and to provide an individual rescue apparatus which benefits, in the passive state, from being discrete and comfortable around the waist, and if needed, at the time of inflation, keeping the person stable with the head out of the water.

To facilitate understanding and simplify the terminology, the apparatus will be defined assuming an orientation as if worn around a standing or upright person, the terms "front," "rear," referring to this position.

The apparatus provided by the invention comprises a support belt having at its extremities attaching means, an inflating system itself to be secured to the support belt, a pressurized gas reservoir adapted to be placed in communication with the inflating system, and release means for assuring the inflation of said system by means of the reservoir; according to the present invention, the apparatus is characterized in that:

the inflating system comprises, first, a tubular portion extending along the support belt and connected to the gas reservoir; and, gas cells or balloons spaced along this portion and communicating therewith for inflating the cells by the action of release means;

the support belt comprises an upward extension, of a height adapted to be rise approximately above the center of gravity of the person when the support belt is worn around the waist, said extension being provided with an attaching zone in its upper portion;

the inflating system is maintained, in the passive position, along the support belt by releasable securing means, capable upon inflation of being released by means of the cells of the system;

flexible connecting means are provided between the support belt and the inflating system, comprising at least one flexible connection connecting the fastening zone of the extension and the inflating system, this connection having a length at least equal to the height of the extension.

Thus, in the passive state, the apparatus is worn around the waist in the manner of a simple belt, and remains discrete and comfortable. As will be understood better hereafter, upon inflation, the flotation cells are released from the support belt and a righting force is exerted upon the upward extension of the support belt, tending to direct upwardly the upper part of the body of the person and bring the person to the surface. When the inflating system is completely inflated (active state), the flotation forces maintain the person on the surface, the head emerging above the surface.

According to a first embodiment, the inflating system may be freed overall with respect to the support belt at the time of inflation. The inflating system remains connected to the support belt, by the aforementioned flexible connection which connects to the attaching zone of the upward extension and the tubular portion of the system, and by the interconnection of other flexible connections arranged along the support belt; these other connections connect the support belt and the tubular portion of the system and have a length at least equal to twice the height of the extension, to permit the tubular portion to rise freely along the body.

According to another embodiment, the releasable securing means may be adapted to release at the time of inflation only the cells of the inflating system, the tubular portion remaining secured to the support belt. The flexible connection between the support belt and the inflating system thus comprises the aforementioned flexible connection, which connects the attaching zone of the extension and one of the cells, and other flexible connections which connect each cell to the support belt or the tubular portion. In this embodiment, the flexible connections may comprise tubular conduits having a complementary function of bringing the cells into communication with the tubular portion of the inflating system.

In either embodiment, the releasable securing means may very simply comprise an envelope fixed along the support belt for containing the tubular portion and the cells of the inflating system. This envelope is provided with closing means adapted to open upon expansion of the inflating system, either, in the first embodiment, for entirely freeing the inflating system, or, in the second embodiment, for freeing only the cells.

The upward extension of the support belt preferably comprises a semi-rigid plate, particularly of a triangular shape, situated in the median dorsal position along the support belt. This extension may be provided fixed in such a manner as to project permanently from the support belt or, be retractable in such a manner as to remain retracted at the level of the support belt when the apparatus is in the passive state, and to be extended at the moment of release.

In a manner known by itself, the gas reservoir may comprise a small bottle, the release means comprising a valve with a controlled opening, mounted on the bottle. The bottle and this valve are fixed in the dorsal position on the aforementioned plate.

The opening of the valve may be achieved either by means of a control cord, running along the support belt with a handle in front, or by means of automatic opening means which operates in the presence of water. Such automatic opening means are well known and exist in commercially available valves which are provided with such means (those comprising generally a water soluble pellet which frees an opener which then pierces a closure on the bottle).

The invention hereinbefore described in its general form will be better understood from a reading of the following description and an examination of the accompanying claims which present by way of non-limiting example one embodiment of the invention; in these drawings which form an integral part of the description:

Figure 1:
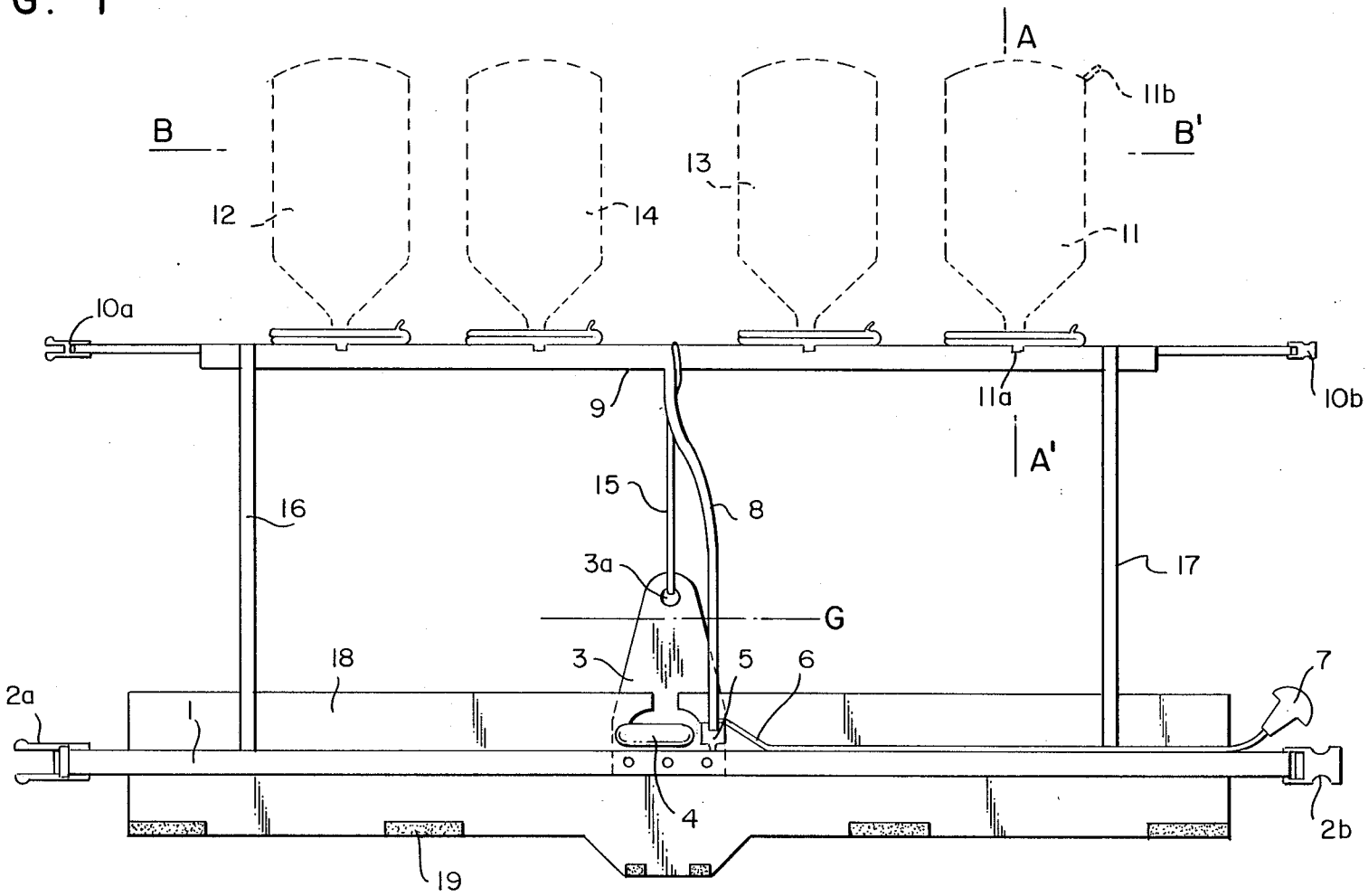
FIG. 1 is a rear view of the device, the device being assumed to be flat in the completely released state (in this figure the cells are schematically shown in solid line in the deflated state, and in broken line in the inflated state)
Figure 3:
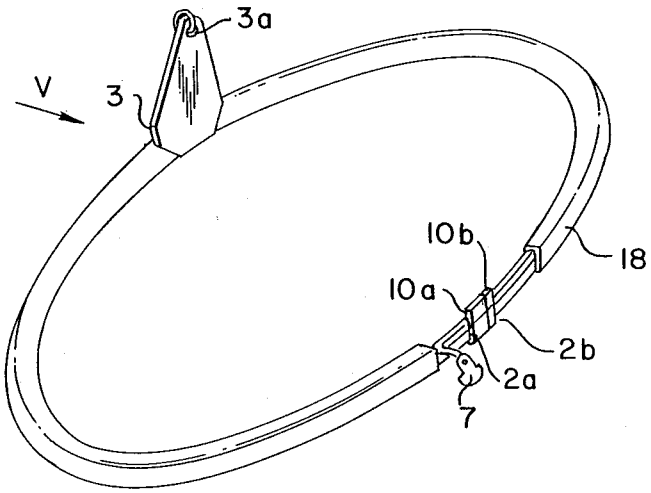
FIG. 3 is a schematic view of the assembly of the apparatus, such that it shows the passive state when arranged around the waist of a person.
Figure 2:
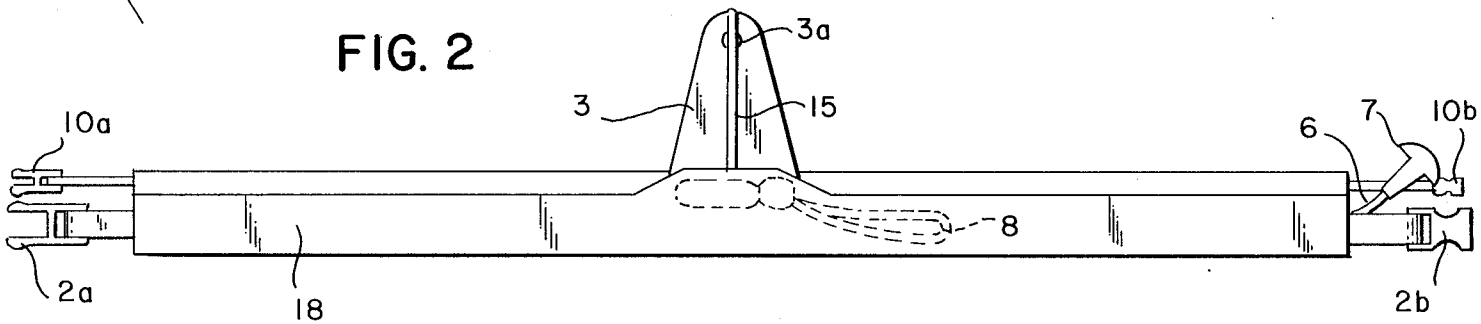
FIG. 2 is a rear view of the device, the inflating system being assumed fastened to the support belt.
Figure 4:
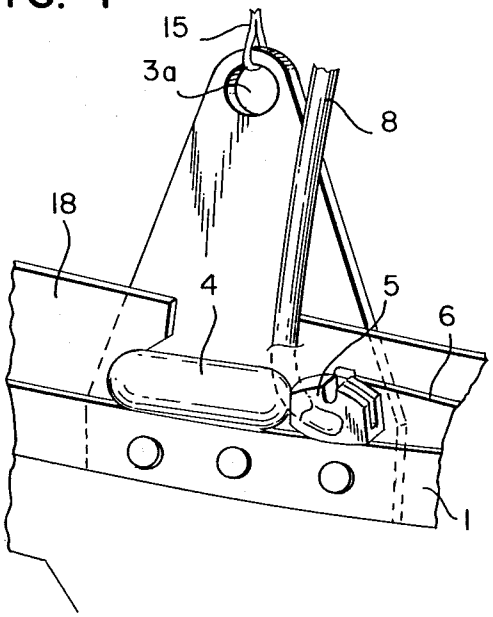
FIG. 4 is a detail view along arrow V.

The individual rescue apparatus shown by way of example in the drawings is intended to be rolled up around the waist of a person in the manner of a belt, in order to assure, in case of need, the formation of a flotation volume.

The device comprises a support belt 1 of a flexible synthetic material and of a length adapted to go around the waist of the person using the device. At its extremities, this support belt is provided with attaching means 2*a* and 2*b* of a conventional type, permitting a lengthwise adjustment.

In the central dorsal position of the support belt is fixed thereon (in the example by three flat rivets) an upward extension comprising a plate 3 of a semi-rigid synthetic material. This plate 3 may in particular have a triangular shape as shown in such a manner as to be firmly fixed by its base on the belt and to extend in the plane thereof. In the example, the base of the plate is interposed between the support belt and the back of the person, which assures a good retention of the plate against the back.

The plate 3 comprises on its upper portion an attaching hole 3*a*. Its height is such that the hole is positioned and situated above the level of the center of gravity of the person when the device is in place. Depending upon the user, a height of approximately 10 to 20 centimeters will suffice, in particular a height on the order of 15 cm for an adult of average size.

On the lower part of the plate and on the rear thereof, is fixed a small bottle 4 of carbon dioxide gas under pressure, provided with a conventional opening valve 5. This valve comprises a piercing member which may be caused to perforate a closure for the bottle, by pivoting an articulated arm having the point at the edge thereof. This arm is connected to a control cord 6 which runs along the support belt and is provided in the front with a handle 7 in front of the user. The valve 5 is connected with a flexible conduit 8 and places the bottle 4 in communication with the conduit when actuated. The elements of this well known valve have not been described further in the drawings.

The apparatus further comprises a closed, flexible tubular portion 9 which is connected to the flexible conduit 8. This tubular portion 9 extends parallel to the support belt 1 and comprises at its extremities elastic attaching means 10*a* and 10*b*, which comprise in particular elastic portions carrying conventional attaching members.

The length of the tubular portion 9 is of the same order as that of the support belt 1. Said tubular portion carries along its length, four small balloons or cells 11, 12, 13, 14, two of the cells 11 and 12 being arranged in the vicinity of the ends of the belt so as to be positioned in front of the person, and the other two 13 and 14 being arranged on opposite sides of the plate 3 so as to be at the rear of the user. Each cell is fixed to the tubular portion 9 by an opening such as 11*a*, by which it communicates with the tubular portion.

Figure 5:
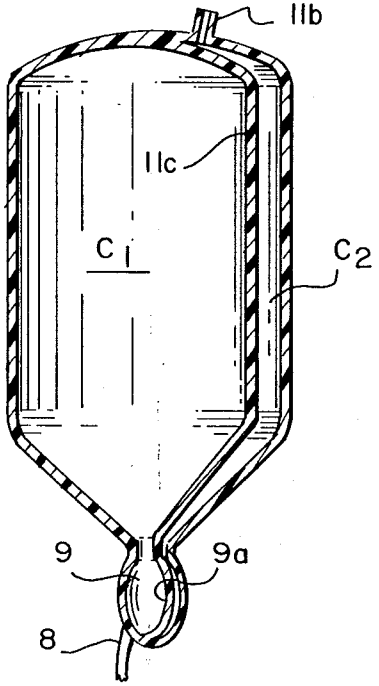
FIGS. 5 and 6 are partial cross sectional views, respectively along a vertical plane AA' and a horizontal plane BB', showing the compartmentalization of the cells.
Figure 6:
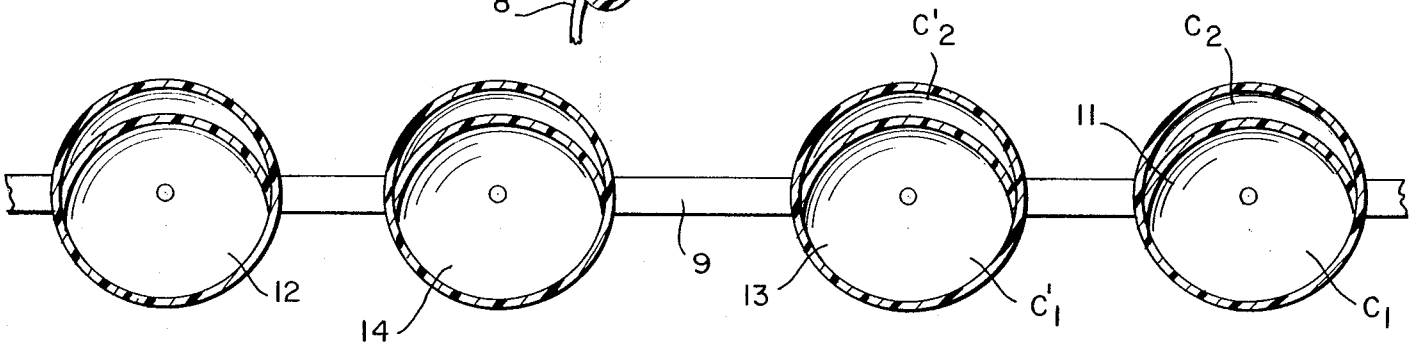

Each cell is separated into two compartments $C_1$, $C_2$, by a flexible partition such as 11*c*; one of the cells is provided with an inflating mouthpiece 11*b* provided with a check valve, which opens into one of the compartments of the cell (shown deflated in FIGS. 5 and 6); this compartment is in communication with the homologous compartments $C'_2$... of the other cells by the tubular portion 9, which is itself separated in two by a flexible partition 9*a* which is continuous with the partition 11*c* (FIGS. 5 and 6). Such a partitioning defines two sealed assemblies of compartments, one ($C_2$, $C'_2$...) in communication with the mouthpiece, and the other ($C_1$, $C'_1$...) in communication with the flexible conduit 8.

These cells may be folded to the deflated state along the tubular portion 8.

As shown by the illustrated example, the tubular portion 9 may particularly comprise a non-inflatable flexible conduit, of a flat shape in the absence of gas. In this case, said portion 9 has as its only function to assure the communication between the conduit 8 and the cells, and therefor between the bottle and said cells when the cord 6 is actuated.

In this embodiment, the cells each have a volume in the inflated state on the order of 2 to 2.5 liters in such a manner that the total flotation volume is on the order of 8 to 10 liters. It will be understood that for children, these volumes may be reduced.

In a variation, the tubular portion may comprise an inflatable pocket of an elongated form, having a dual function, first to assure the communication mentioned above, and second to itself form a part of the flotation volume once inflated; this volume adds to that of the cells which may be provided with reduced dimensions.

Further, the tubular portion 9 is connected to the support belt 1 by flexible connections, in the example 3 in number, one 15 situated to the rear, and the other two 16 and 17 situated in front.

The flexible dorsal connection 15 is in the example a cord connecting the attaching hole 3*a* of the plate 3 to the rear mid-portion of the tubular portion 9. The length of this connection is approximately equal to the height of the plate such that the portion 9 may, either be lowered to the passive position above the support belt, or come to be positioned in the active position a distance from the support belt on the order of double the height of the plate 3.

Each vertical connection 16 or 17 is, in the example comprised of a lanyard connecting the support belt and the tubular portion, of a length on the order of twice the height of the plate 3. Thus, as shown in the drawings, the tubular portion 9 comes to be arranged, in the active state, in a position approximately parallel to the support belt when the connections 15, 16 and 17 are extended upwardly It should be noted that the flexible conduit 8 has a length sufficient to allow the upward displacement of the tubular portion 9.

Further, an envelope 18 is fixed along the support belt in order to be able to contain the tubular portion 9 and the cells 11–14 in the passive state, in the deflated condition on the belt.

This envelope is formed by a flexible wall which projects above and below the belt in such a manner as to be able to be closed around the portion 9 and the cells. Closure means such as adhesive strips 19 keep the envelope in the closed state and permit the same to open during expansion of the cells upon release of the device In the example, the envelope 18 is secured to the front face of the support belt in such a manner as to pass around the rear of the plate 3.

FIGS. 5 and 6 show respectively the front and the back, the device in place in the passive state around the waist of a person. The envelope 18 contains the cells 11–14, the tubular portion 9, the flexible conduit 8 and the operating cord 6 which extends to the front with a handle 7; the straps 2 and 10 of the support belt and the tubular portion connect the two extremities of these elements. To the rear, the bottle and its valve are hidden by the envelope. The assembly forms a discrete device the wearing of which is comfortable and does not cause any significant discomfort for the user. The plate 3 rises about 15 cm. in the back of the user, just above his center of gravity G, but is not noticed in an objectionable manner When the wearer pulls on the handle 7, he causes the perforation of the cover of the bottle 4 and places the cells in communication therewith through the flexible conduit 8 and the tubular portion 9. The pressurized gas inflates the cells which brings about the opening of the envelope 18.

Figure 7:
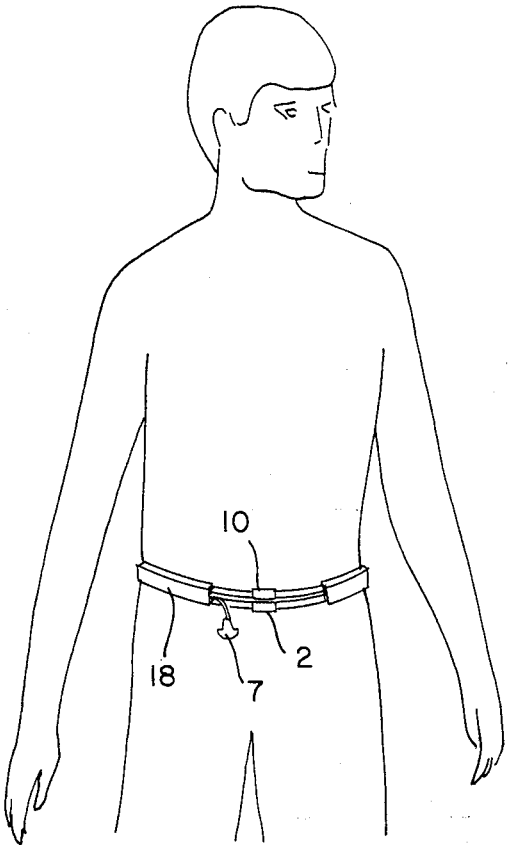
FIGS. 7 and 8 are schematic views of the device, in the passive state, worn by a person.

The inflating system (tubular portion 9 and cells 11–14) is thus released and is subjected to an upward force in the water. This vertical force is directed upwardly, is exerted firstly on the attaching point *3a* of the plate. As shown schematically in FIG. 7, if the wearer is positioned with his head downwardly, this force tends to right the person and to arrange him in an upright position such as shown in FIGS. 8 and 9.

Figure 8:
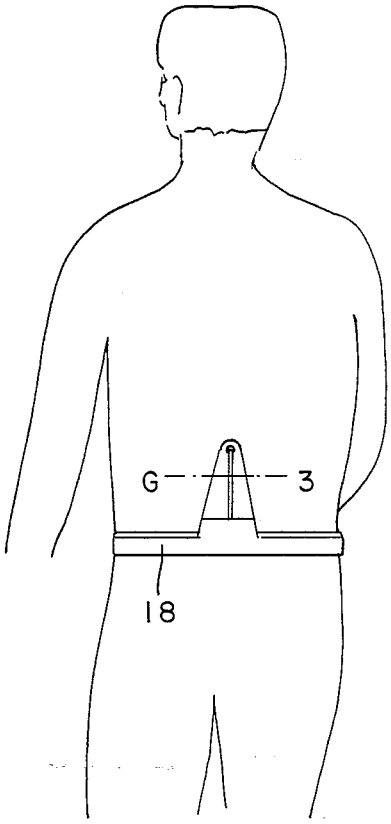
Figure 9:
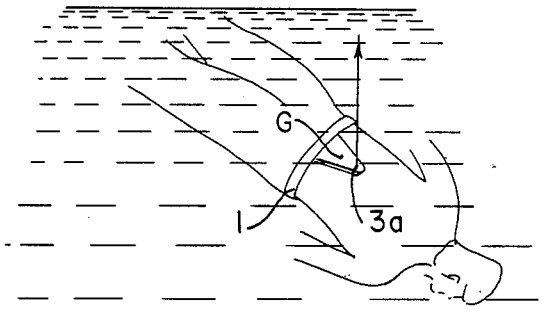
FIG. 9 is an explanatory view of the operation of the device.
Figure 10:
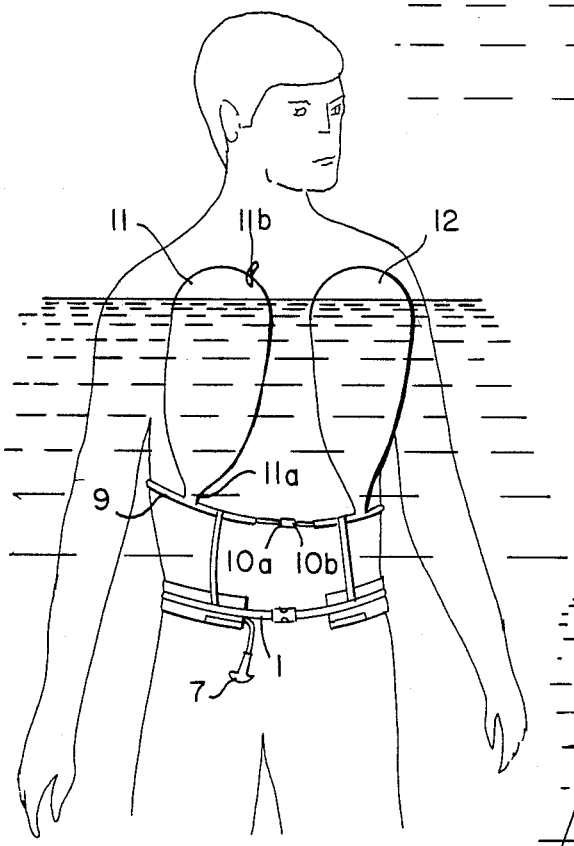
FIGS. 10 and 11 are analogous schematic views of the device in the active state, after inflation of the inflating system.
Figure 11:
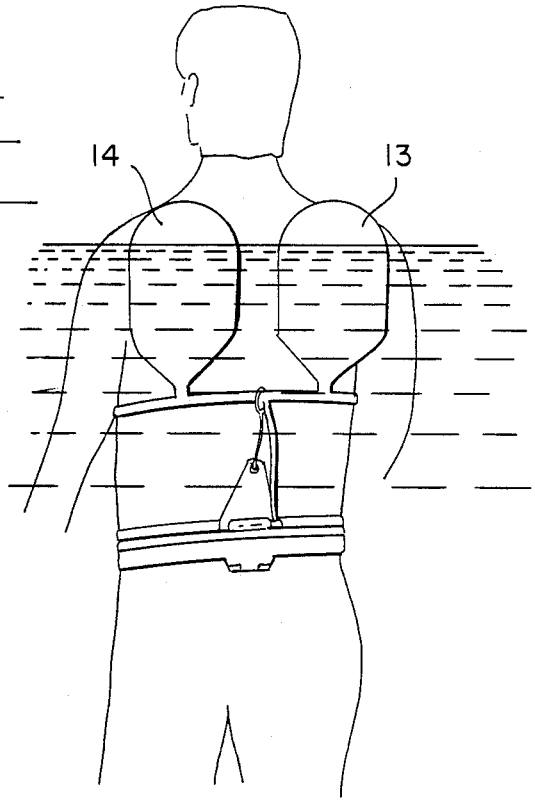

In the completely inflated state, the cells cause the tubular portion 9 to rise length of the wearer (due to the elasticity of the straps 10*a*, 10*b*), to the position of FIGS. 8 and 9. In this position, the wearer is kept with his head above the water, without risk of being inverted.

I claim:

1. An individual rescue apparatus for use around the waist of a person comprising a support belt (1) having attaching means (2*a*, 2*b*) at its extremities, an inflation system (9–14) adapted to be secured to said support belt, a pressurized gas reservoir adapted to be able to be placed in communication with the inflation system, and release means adapted to assure the inflation of said system from said reservoir from a passive, uninflated position to an active, inflated position, said inflation system comprising a tubular portion (9) extending along the support belt and connected to said gas reservoir, and cells (11–14) distributed along the tubular portion and communicating therewith for inflating the cells by the action of the releasing means, said support belt (1) comprising an upward extension (3) of a height adapted to extend approximately above the center of gravity of the person when the belt is worn around the waist, said extension (3) being provided with an attaching zone (*3a*) in its upper portion, said inflation system (9–14) being maintained, in the passive position, along the support belt (1) by releasable securing means (18, 19) capable upon inflation of releasing at least the cells (11–14) of said system, connecting means (15–17) being provided between the support belt and the inflation system, comprising at least one connection (15) connecting the attaching zone (*3a*) of the extension and the inflation system.

2. A rescue apparatus as in claim 1, characterized in that:

the releasable securing means (18, 19) is adapted to release upon inflation the entire inflation system (9–14), the connecting means comprising a flexible connection (15) connecting the attaching zone (*3a*) and the tubular portion (9) of the inflation system, and additional flexible connections (16, 17) arranged along the support belt (1) and connecting said support belt and said tubular portion, said additional flexible connections having a length at least equal to twice the height of the extension (3).

3. A rescue apparatus as in claim 2, characterized in that the tubular portion of the inflation system comprises an inflatable pocket of elongated shape, having the function of assurance of the communication between the reservoir and the cells, and of serving as flotation volume upon inflation.

4. A rescue apparatus as in claim 3, characterized in that the tubular portion (9) of the inflation system comprises at its extremities elastic attaching means (10*a*, 10*b*) permitting the connection of said extremities with a freedom of longitudinal extension.

5. A rescue apparatus as in claim 4, characterized in that the releasable securing means comprises an envelope (18) fixed along the support belt (1) for containing the tubular portion (9) and the cells (11–14) of the inflation system, said envelope being provided with closure means (19) adapted to be opened upon expansion of the inflation system.

6. A rescue apparatus as in claim 5, characterized in that the upward extension (3) of the support belt comprises a semi-rigid plate, situated in the median dorsal position along said belt.

7. A rescue apparatus as in claim 6 and wherein said semi-rigid plate has a height of about 10–25 cm, said flexible connection having a length approximately equal to the height of said plate.

8. A rescue apparatus as in claim 7 said additional flexible connections include two flexible connections (16, 17) situated in a ventral position along the support belt.

9. A rescue apparatus as in claim 8, in which the gas reservoir comprises a small bottle (4), and the releasing means comprises a valve with controlled opening (5), mounted on said bottle, characterized in that said bottle (4) and said valve (5) are fixed in the dorsal position on the plate (3), the valve being connected to the tubular portion (9) of the inflation system by a flexible conduit (8) of a length adapted to maintain the faculty of upward displacement of the inflation system upon inflation.

10. A rescue apparatus as in claim 9, characterized in that a control cord (6) is associated with the valve (5) for opening the valve, said cord running along the support belt (1) with a ventral operating handle (7).

11. A rescue apparatus as in claim 9, characterized in that one of the cells (11), situated in a front position, is provided with an inflation mouthpiece (**11*b*) provided with a one-way valve, the cells and the tubular portion being compartmentalized in such a manner as to define an assembly of compartments ($C_2$, $C'_2$...) in communication with the mouthpiece (11*b*) and an assembly of compartments ($C_1$, $C'_1$...) in communication with the flexible conduit (8**).

12. A rescue apparatus as in claim 11 characterized in that it comprises four cells: two in front (11, 12) in the vicinity of each extremity of the belt, and two in the rear (13, 14) on opposite sides of the semi-rigid plate (3).

* * * * *